US010381153B2

(12) United States Patent
Honda

(10) Patent No.: US 10,381,153 B2
(45) Date of Patent: Aug. 13, 2019

(54) SPACER FIXING STRUCTURE

(71) Applicant: TABUCHI ELECTRIC CO., LTD., Osaka-shi, Osaka (JP)

(72) Inventor: Keisuke Honda, Osaka (JP)

(73) Assignee: TABUCHI ELECTRIC CO., LTD., Osaka (JP)

( * ) Notice: Subject to any disclaimer, the term of this patent is extended or adjusted under 35 U.S.C. 154(b) by 73 days.

(21) Appl. No.: 15/406,613

(22) Filed: Jan. 13, 2017

(65) Prior Publication Data

US 2017/0207021 A1 Jul. 20, 2017

(30) Foreign Application Priority Data

Jan. 15, 2016 (JP) ..... 2016-005782

(51) Int. Cl.

| | |
|---|---|
| ***H01F 27/24*** | (2006.01) |
| ***H01F 27/32*** | (2006.01) |
| ***H01F 41/02*** | (2006.01) |
| ***H01F 3/14*** | (2006.01) |
| ***H01F 27/26*** | (2006.01) |
| ***H01F 27/34*** | (2006.01) |

(52) U.S. Cl.

CPC ..... *H01F 27/324* (2013.01); *H01F 3/14* (2013.01); *H01F 27/24* (2013.01); *H01F 27/263* (2013.01); *H01F 27/346* (2013.01); *H01F 41/02* (2013.01)

(58) Field of Classification Search

CPC ..... H01F 27/00–27/36
USPC ..... 336/65, 90, 96, 210, 211, 212, 214–219, 336/233–234
See application file for complete search history.

(56) References Cited

U.S. PATENT DOCUMENTS 8,461,955 B2 * 6/2013 Yokota ..... H01F 37/00 29/602.1
2009/0315663 A1 * 12/2009 Kiyono ..... H01F 3/14 336/219
2013/0002384 A1 * 1/2013 Tokota ..... H01F 27/022 336/96

FOREIGN PATENT DOCUMENTS

JP 2003-217945 A 7/2003
JP 2009032922 A * 2/2009

* cited by examiner

*Primary Examiner* — Tuyen T Nguyen
(74) *Attorney, Agent, or Firm* — Maschoff Brennan

(57) ABSTRACT

Disclosed herein is a spacer fixing structure including a core member constituting a core to be wound with a coil; and a plate spacer fixed to the core member. The spacer has a loop shape. A communication groove is formed in at least one surface of front and back surfaces of the spacer, and extends radially to communicate with inner and outer peripheries of the spacer. A region of the at least one surface of the spacer other than a grooved portion is left as a flat surface. At least the flat surface of the spacer is adhered to the core member via an adhesive layer made of an adhesive.

3 Claims, 6 Drawing Sheets

SPACER FIXING STRUCTURE

CROSS-REFERENCE TO RELATED APPLICATION

This application claims priority to Japanese Patent Application No. 2016-005782 filed on Jan. 15, 2016, the entire disclosure of which is hereby incorporated by reference.

BACKGROUND

The present disclosure relates to a structure for fixing a plate spacer to a core member.

Japanese Unexamined Patent Publication No. 2003-217945 discloses a structure for fixing a disk-like spacer to a pair of core members by sandwiching the spacer between the core members.

SUMMARY

A spacer fixing structure according to the present disclosure includes a core member constituting a core to be wound with a coil; and a plate spacer fixed to the core member. The spacer has a loop shape. A communication groove is formed in at least one surface of front and back surfaces of the spacer, and extends radially to communicate with inner and outer peripheries of the spacer. A region of the at least one surface of the spacer other than a grooved portion is left as a flat surface. At least the flat surface of the spacer is adhered to the core member via an adhesive layer made of an adhesive.

DETAILED DESCRIPTION

Figure 1:
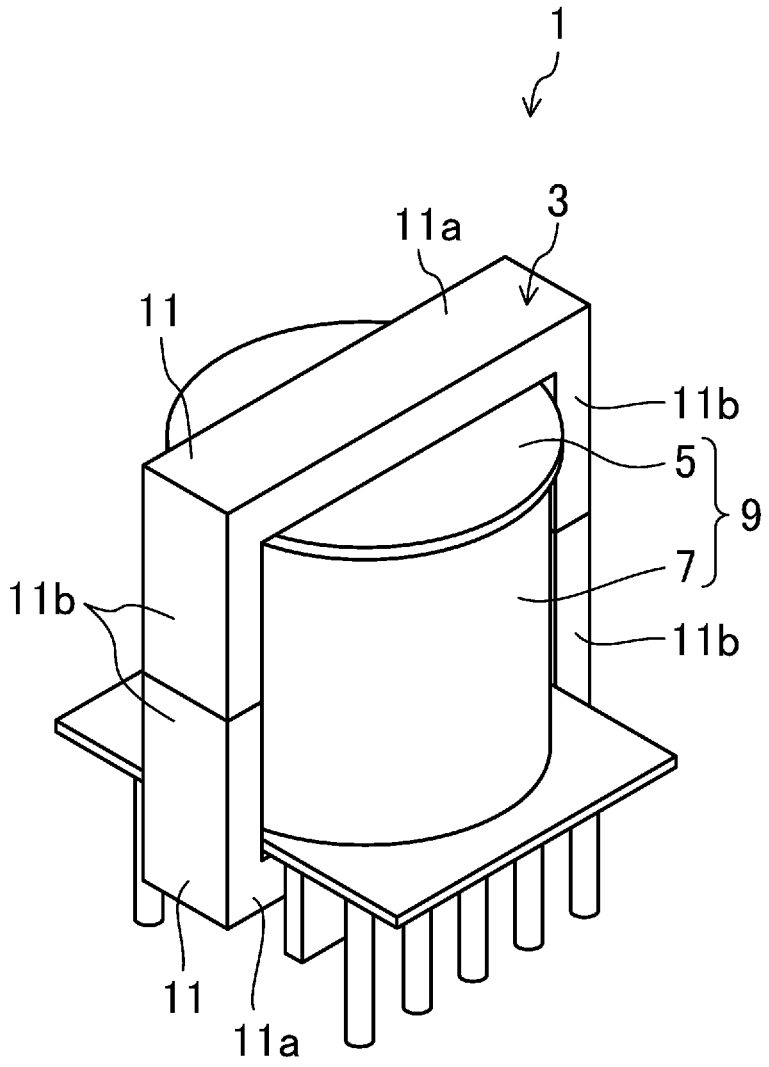
FIG. 1 is a perspective view of a choke coil having a spacer fixing structure according to an embodiment of the present disclosure.

Another method of fixing a spacer to a core member is as follows. An adhesive is applied to a front/back surface of the spacer to be adhered and/or a portion of the core member to be adhered. With the front/back surface of the spacer facing the portion of the core member, the spacer and/or the core member is/are pressed in a direction in which the front/back surface of the spacer and the portion of the core member approach each other. As a result, the spacer is fixed to the core member via an adhesive layer made of the adhesive. If this method is employed for fixing the disk-like spacer to the core members of Japanese Unexamined Patent Publication No. 2003-217945, the adhesive is extruded only to the outer periphery of the spacer when the spacer and/or the core member is/are pressed. It is thus difficult to form the adhesive layer with a small thickness. A thick adhesive layer causes large variations in its thickness when manufacturing conditions vary or a temperature changes, thereby causing large variations in inductance. The coefficient of thermal expansion of an adhesive is generally higher than that of a spacer or a core member. Thus, a thick adhesive layer also causes large variations in inductance at a temperature change.

The present disclosure was made in view of the problems and aims to reduce variations in inductance.

Some of the features of the present disclosure are that a spacer has a loop shape, and that a communication groove is formed in at least one surface of front and back surfaces of the spacer and extends radially throughout the whole length.

In this configuration, with the adhesive applied to the front/back surface of the spacer to be adhered, and/or a portion of the core member to be adhered, the spacer and/or the core member is/are pressed in a direction in which the front/back surface of the spacer and the portion of the core member approach each other. Then, the adhesive between the non-grooved region of the front/back surface of the spacer and the portion of the core member is extruded not only to the outer periphery of the spacer but also to the inner periphery of the spacer and into the communication groove. As a result, the adhesive layer is easily formed with a small thickness between the non-grooved region of the spacer and the portion of the core member. This configuration easily reduces variations in the thickness of the adhesive layer even when manufacturing conditions vary or a temperature changes, thereby easily reducing variations in the inductance.

Specifically, the present disclosure provides, as a first aspect, a spacer fixing structure including a core member constituting a core to be wound with a coil; and a plate spacer fixed to the core member. The spacer has a loop shape. A communication groove is formed in at least one surface of front and back surfaces of the spacer, and extends radially to communicate with inner and outer peripheries of the spacer. A region of the at least one surface of the spacer other than a grooved portion is left as a flat surface. At least the flat surface of the spacer is adhered to the core member via an adhesive layer made of an adhesive.

In this configuration, with the adhesive applied to the flat surface of the spacer and/or a portion of the core member facing the flat surface, the spacer and/or the core member is/are pressed in a direction in which the flat surface and the facing portion approach each other. The adhesive between the flat surface and the facing portion is extruded not only to the outer periphery of the spacer but also to the inner periphery of the spacer and into the communication groove. As a result, the adhesive layer is easily formed with a small thickness between the flat surface and the facing portion. This configuration easily reduces variations in the thickness of the adhesive layer even when manufacturing conditions vary or a temperature changes, thereby easily reducing variations in the inductance.

In the structure according to the above aspect, at least one loop-shaped groove extending along a circumference of the spacer may be further formed in the at least one surface of the spacer.

With the adhesive applied to the flat surface of the spacer and/or the portion of the core member facing the flat surface, the spacer and/or the core member is/are pressed in the direction in which the flat surface and the facing portion approach each other. Then, the adhesive between the flat surface and the facing portion is extruded into the loop-shaped groove as well. As a result, the adhesive layer is easily formed with a smaller thickness between the flat surface and the facing portion. This configuration further reduces variations in the inductance.

In the structure according to the above aspect, the spacer may have a ring shape. The loop-shaped groove may be coaxial with the spacer.

With the adhesive evenly applied to the flat surface of the spacer and/or the portion of the core member facing the flat surface, the spacer and/or the core member is/are pressed in the direction in which the flat surface and the facing portion approach each other. Then, the adhesive between the flat surface and the facing portion is easily and evenly extruded into the loop-shaped groove. As a result, the adhesive layer is formed with a uniform thickness between the flat surface and the facing portion.

In the structure according to the above aspect, the at least one loop-shaped groove may include a plurality of loop-shaped grooves.

With the adhesive applied to the flat surface of the spacer and/or the portion of the core member facing the flat surface, the spacer and/or the core member is/are pressed in the direction in which the flat surface and the facing portion approach each other. Then, the adhesive between the flat surface and the facing portion is extruded into the loop-shaped grooves. As a result, the adhesive layer is more easily formed with a smaller thickness between the flat surface and the facing portion. This configuration more easily reduces variations in the inductance.

The present disclosure provides, as a second aspect, a method of fixing a plate spacer to a core member constituting a core to be wound with a coil. The spacer has a loop shape. A communication groove is formed in at least one surface of front and back surfaces of the spacer, and extends radially to communicate with inner and outer peripheries of the spacer. A region of the at least one surface of the spacer other than a grooved portion is left as a flat surface. One of the at least one surface of the spacer is to be adhered to the core member. The method includes: applying an adhesive to the flat surface of the one of the at least one surface of the spacer and/or a portion of the core member to be adhered; with the one of the at least one surface of the spacer facing the portion of the core member, pressing the spacer and/or the core member in a direction in which the flat surface of the spacer and the portion of the core member approach each other to extrude part of the adhesive between the flat surface of the spacer and the portion of the core member to the inner and outer peripheries of the spacer and into the communication groove; and curing the adhesive to form an adhesive layer at least between the flat surface of the spacer and the portion of the core member.

In this method, the spacer and/or the core member is/are pressed to extrude the adhesive between the flat surface of the spacer and the portion of the core member not only to the outer periphery of the spacer but also to the inner periphery of the spacer and into the communication groove. As a result, the adhesive layer is easily formed with a small thickness between the flat surface of the spacer and the portion of the core member. This configuration easily reduces variations in the thickness of the adhesive layer even when manufacturing conditions vary or a temperature changes, thereby easily reducing variations in the inductance.

FIG. 1 illustrates a choke coil 1 having a spacer fixing structure according to an embodiment of the present disclosure.

The choke coil 1 includes a core 3 and a bobbin coil 9. A coil is to be wound on the core 3. The bobbin coil 9 is formed by winding a coil body 7 on a bobbin 5. The bobbin coil 9 is attached to the core 3 so that the coil body 7 is wound on the core 3 via the bobbin 5.

Figure 2:
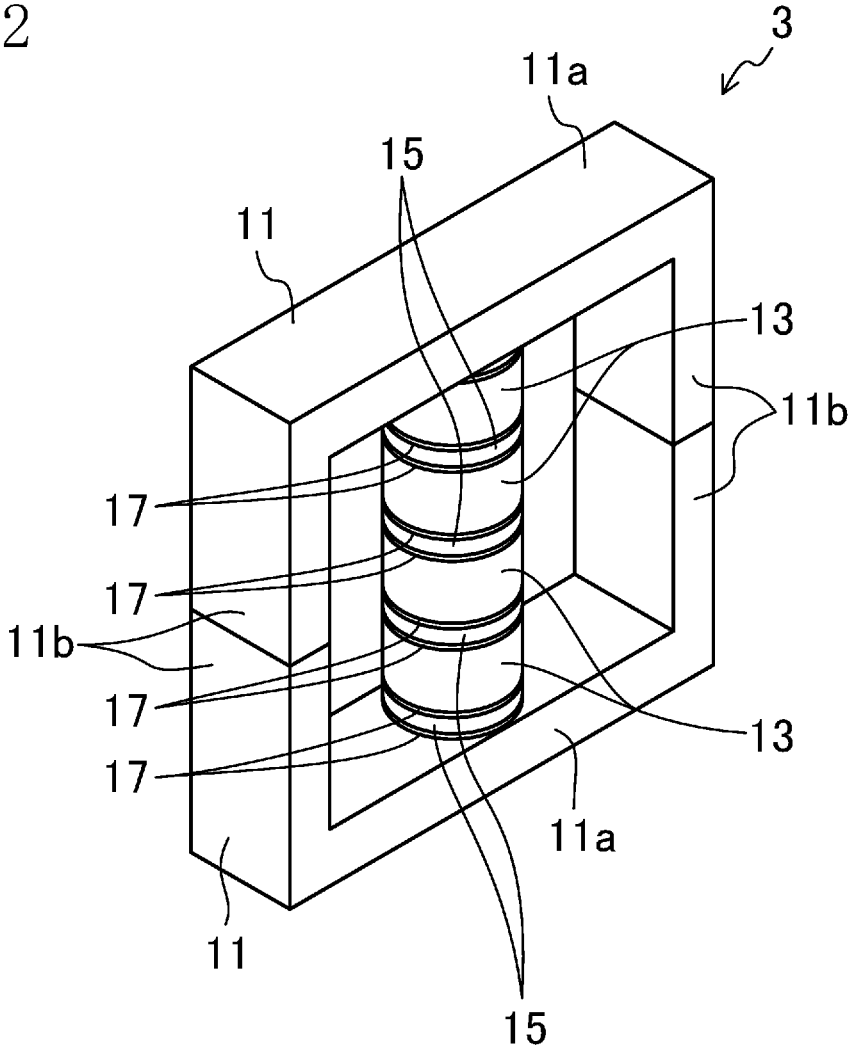
FIG. 2 is a perspective view of a core.
Figure 3:
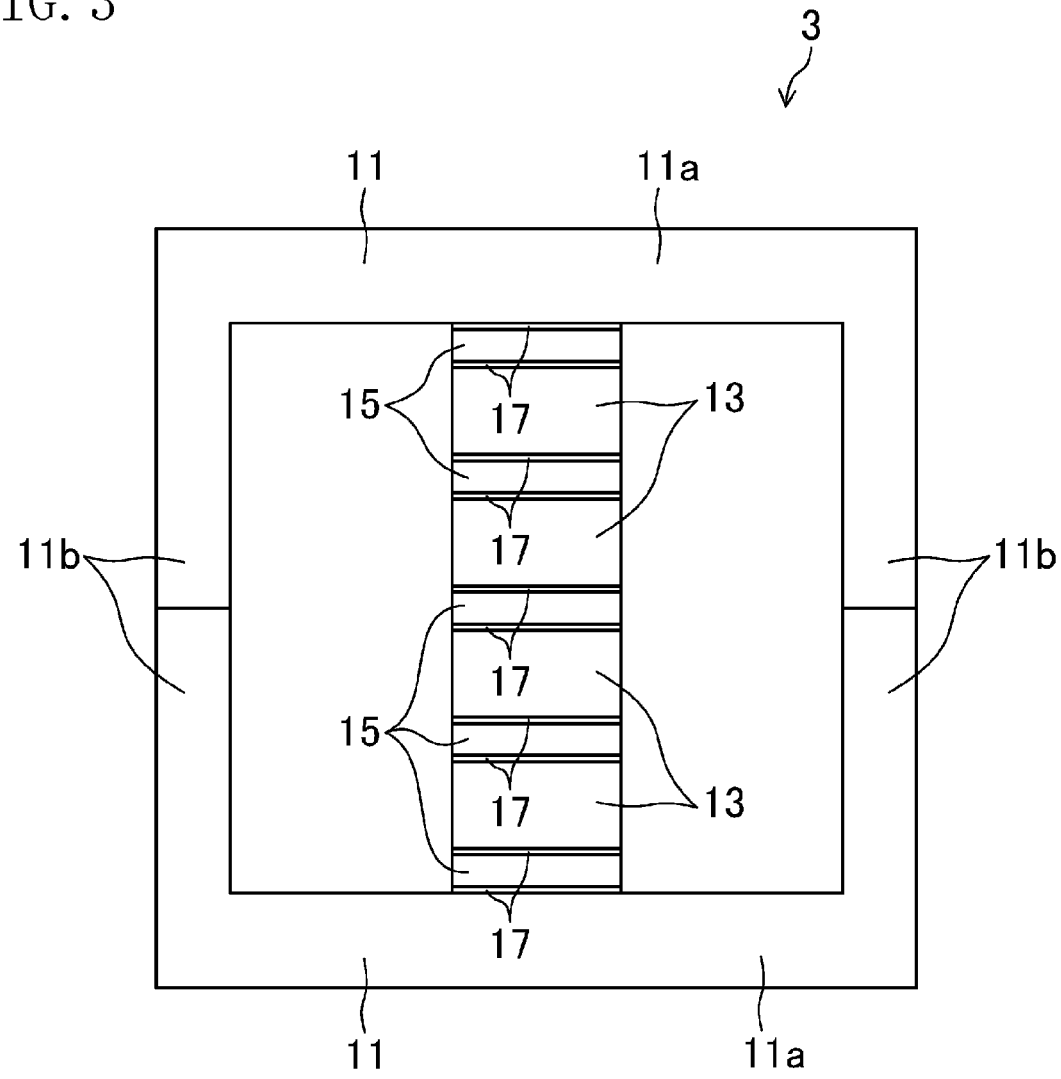
FIG. 3 is a front view of the core.
Figure 4:
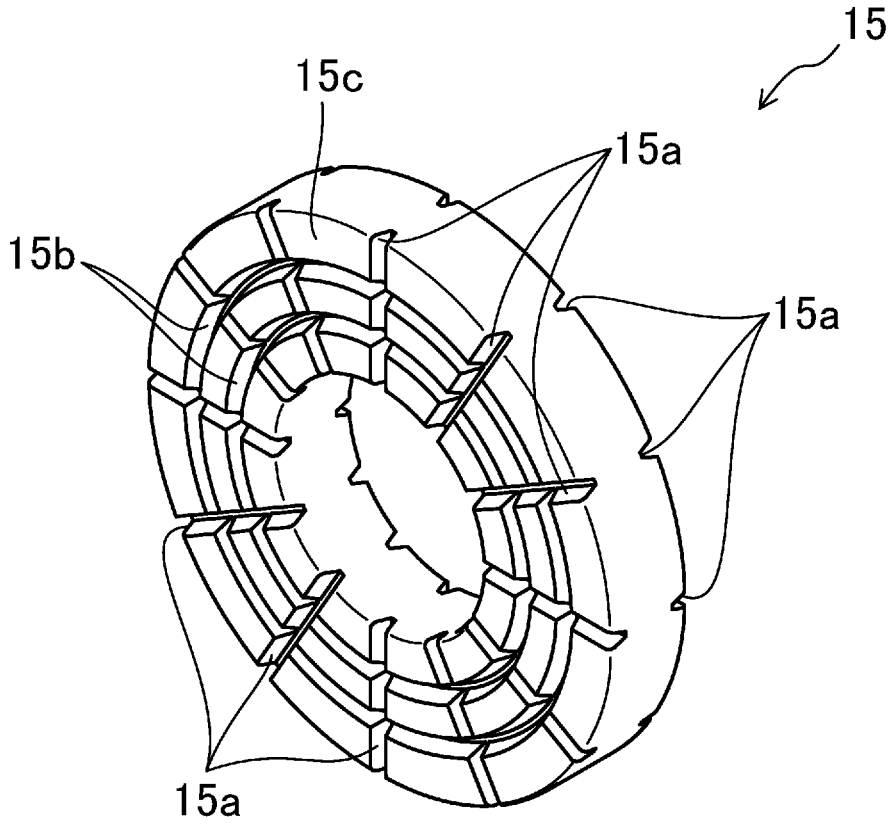
FIG. 4 is a perspective view of a spacer.
Figure 5:
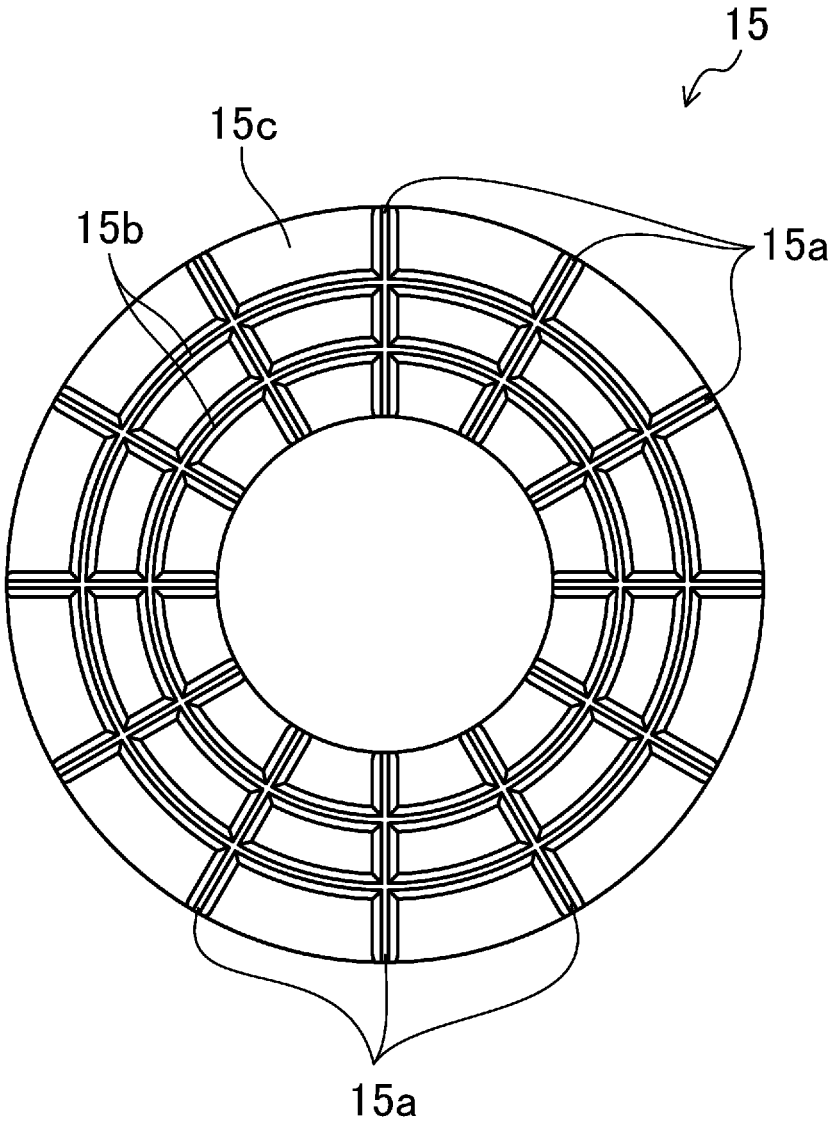
FIG. 5 is a top view of the spacer.
Figure 6:
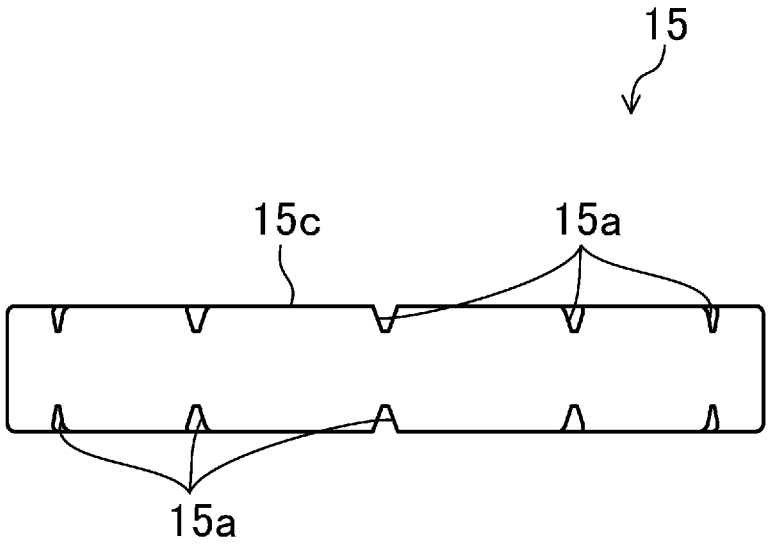
FIG. 6 is a front view of the spacer.
Figure 7:
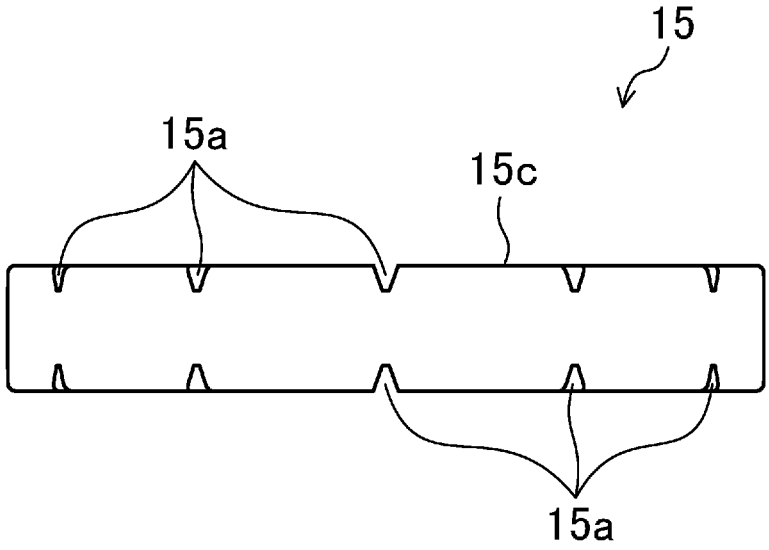
FIG. 7 is a left side view of the spacer.

As shown in FIGS. 2 and 3, the core 3 includes a pair of U-shaped outer core members 11. The U-shape is composed of a facing part 11*a*, which is a rectangular plate, and plate legs 11*b*, which protrude from two longitudinal ends of the facing part 11*a*. Open end surfaces of the outer core members 11 abut on each other. Between the longitudinal centers of the facing parts 11*a* of the outer core members 11, four cylindrical inner core members 13 and five ring plate spacers 15 are arranged coaxially and alternately. The axes of the inner core members 13 and spacers 15 are along a direction in which the facing parts 11*a* face each other. The spacers 15 have the same outer diameter as the inner core members 13. The outer and inner core members 11 and 13 are made of, for example, a powder magnetic material such as iron dust or Sendust, or ferrite. The spacers 15 are made of a non-magnetic material such as phenol resin.

As shown in FIGS. 4-7, twelve communication grooves 15*a* and two loop-shaped grooves 15*b* are formed in each of front and back surfaces of each spacer 15. The communication grooves 15*a* are arranged circumferentially at regular intervals, and extend radially to communicate with the inner and outer peripheries of the spacer 15. The loop-shaped grooves 15*b* being coaxial with the spacer 15 and extending circumferentially are arranged at regular intervals to radially divide the grooved surface into three. The depth(s) of the communication grooves 15*a* and the loop-shaped grooves 15*b* fall(s) within a range of about 100 to about 500 μm, for example. The region of each surface of the spacer 15 other than the grooved portions is left as a flat surface 15*c*. Each entire surface of the spacer 15 is adhered (or fixed) to the longitudinal center of the facing part 11*a* of an adjacent one of the outer core members 11 or the outer periphery of an end of an adjacent one of the inner core members 13 via an adhesive layer 17 made of an adhesive. The thickness of the adhesive layer 17 between the flat surface 15*c* of each spacer 15 and the adhered portion of the core member 11 or 13 is about 100 for example.

The back view of each spacer 15 is the same as its front view. The right side view of each spacer 15 is the same as its left side view. The bottom view of each spacer 15 is the same as its top view. The back, right side, and bottom views are thus not shown.

How to adhere (or fix) the spacers 15 with the above configuration to the core members 11 and/or 13 will now be described.

First, the adhesive is applied to the entire front or back surface (i.e., the surface with the grooves 15*a* and 15*b*) of each spacer 15, which is to be adhered. The adhesive may be a two-part acrylic adhesive, for example. With the surface of the spacer 15 with the adhesive facing a portion of the core member 11 or 13 to be adhered, the spacer 15 and/or the core member 11 or 13 is/are pressed in a direction in which the surface of the spacer 15 and the portion of the core member 11 or 13 approach each other. Accordingly, the flat surface 15*c* of the spacer 15 with the adhesive and the portion of the core member 11 or 13 (i.e., the portion facing the flat surface 15*c*) approach each other. Then, part of the adhesive between the flat surface 15*c* and the portion of the core member 11 or 13 is extruded to the inner and outer peripheries of the spacer 15 and into the communication grooves 15*a* and the loop-shaped grooves 15*b*. Furthermore, when the flat surface 15*c* of the spacer 15 and the portion of the core member 11 or 13 approach each other, the adhesive flows out of the loop-shaped grooves 15*b* to the communication grooves 15*a*, from which the adhesive is extruded to the inner and outer peripheries of the spacer 15.

After that, the adhesive is cured to be the adhesive layer 17 between the surface of the spacer 15, which includes the communication grooves 15*a*, the loop-shaped grooves 15*b*, and the flat surface 15*c*, and the portion of the core member 11 or 13.

As described above, according to the embodiment, the spacer 15 and/or the core member 11 or 13 is/are pressed. Then, the adhesive between the flat surface 15*c* of the spacer 15 and the portion of the core member 11 or 13 is extruded not only to the outer periphery of the spacer 15 but also to the inner periphery of the spacer 15 and into the communication grooves 15*a* and the loop-shaped grooves 15*b*. As a result, the adhesive layer 17 is easily formed with a small thickness between the flat surface 15*c* of the spacer 15 and the portion of the core member 11 or 13. This configuration easily reduces variations in the thickness of the adhesive layer 17 when manufacturing conditions vary and a temperature changes, thereby easily reducing variations in the inductance.

The loop-shaped grooves 15*b* are coaxial with the spacer 15. Thus, when the spacer 15 and/or the core member 11 or 13 is/are pressed as described above, the adhesive between the flat surface 15*c* of the spacer 15 and the portion of the core member 11 or 13 is easily and evenly extruded into the loop-shaped grooves 15*b*. As a result, the adhesive layer 17 is easily formed with a uniform thickness between the flat surface 15*c* of the spacer 15 and the portion of the core member 11 or 13.

Since the surface of each spacer 15 to be adhered includes the communication grooves 15*a* and the loop-shaped grooves 15*b*, the contact area between the spacer 15 and the adhesive increases, thereby improving the adhesion strength. Therefore, even if stress acts on the core 3 due to vibration or other factors, the spacer 15 is less removable from the core member 11 or 13.

In addition, the plurality of the loop-shaped grooves 15*b* are formed. Thus, when the spacer 15 and/or the core member 11 or 13 is/are pressed as described above, the adhesive between the flat surface 15*c* of the spacer 15 and the portion of the core member 11 or 13 is extruded into the loop-shaped grooves 15*b*. As a result, the adhesive layer 17 is easily formed with a smaller thickness between the flat surface 15*c* of the spacer 15 and the portion of the core member 11 or 13. This configuration reduces variations in the inductance more easily.

While the adhesive is applied only to the surface of the spacer 15 to be adhered in the embodiment described above, it may be applied only to the portion of the core member 11 or 13 to be adhered, or both the surface of the spacer 15 to be adhered and the portion of the core member 11 or 13 to be adhered. While the adhesive is applied to the entire surface of the spacer 15, it may be applied only to the flat surface 15*c*.

While the entire front/back surface of the spacer 15 is adhered to the core member 11 or 13 via the adhesive layer 17 in this embodiment, only the flat surface 15*c* of the spacer 15 may be adhered to the core member 11 or 13 via the adhesive layer 17.

While each of the front and back surfaces of the spacer 15 includes the grooves 15*a* and 15*b* in this embodiment, only one of the front and back surfaces may include the grooves 15 *a* and 15*b* in this embodiment.

What is claimed is:

1. A spacer fixing structure comprising:

a core member constituting a core to be wound with a coil; and a plate spacer fixed to the core member, wherein the spacer has a loop shape, at least one loop-shaped groove extending along a circumference of the spacer is formed in that at least one surface of the spacer, wherein an adhesive layer is extruded into the loop-shaped grove, a communication groove is formed in at least one surface of front and back surfaces of the spacer, and extends radially to communicate with inner and outer peripheries of the spacer, a region of the at least one surface of the spacer other than a grooved portion is left as a flat surface, and at least the flat surface of the spacer is adhered to the core member via the adhesive layer made of an adhesive.

2. The structure of claim 1, wherein the spacer has a ring shape, and the loop-shaped groove is coaxial with the spacer.

3. The structure of claim 1, wherein the at least one loop-shaped groove includes a plurality of loop-shaped grooves.

* * * * *